US008052135B2

(12) United States Patent
Katayama et al.

(10) Patent No.: US 8,052,135 B2
(45) Date of Patent: Nov. 8, 2011

(54) BOOK BINDING APPARATUS FOR PERFECT BOOK BINDING

(75) Inventors: Eiji Katayama, Shiga (JP); Shinichi Takai, Shiga (JP); Masaru Kano, Shiga (JP); Shigeru Wakimoto, Shiga (JP)

(73) Assignee: Horizon International Inc., Shiga (JP)

( * ) Notice: Subject to any disclaimer, the term of this patent is extended or adjusted under 35 U.S.C. 154(b) by 240 days.

(21) Appl. No.: 12/471,591

(22) Filed: May 26, 2009

(65) Prior Publication Data

US 2009/0297297 A1 Dec. 3, 2009

(30) Foreign Application Priority Data

May 28, 2008 (JP) ..... 2008-138932

(51) Int. Cl.

| | |
|---|---|
| ***B65H 37/04*** | (2006.01) |
| ***B42C 9/00*** | (2006.01) |
| ***B42C 5/00*** | (2006.01) |
| ***B42C 11/00*** | (2006.01) |

(52) U.S. Cl. ..... 270/58.08; 270/58.07; 412/4; 412/6; 412/11; 412/14; 412/16; 412/18; 412/19; 412/25; 412/33; 412/37

(58) Field of Classification Search ..... 270/52.14, 270/58.07, 58.08; 412/4, 5, 6, 8, 11, 13, 412/14, 16, 18, 19, 25, 33, 37

See application file for complete search history.

(56) References Cited

U.S. PATENT DOCUMENTS

| | | | | |
|---|---|---|---|---|
| 6,206,358 | B1 * | 3/2001 | Yamaguchi et al. | 270/52.02 |
| 6,352,252 | B1 * | 3/2002 | Schmucker et al. | 270/58.07 |
| 6,443,682 | B2 * | 9/2002 | Marsh | 412/16 |
| 6,447,230 | B1 | 9/2002 | Takai et al. | |

* cited by examiner

*Primary Examiner* — Leslie A Nicholson, III
(74) *Attorney, Agent, or Firm* — Kirschstein, et al.

(57) ABSTRACT

While a book block (P) is nipped between a pair of clamping plates (1*a*, 1*b*) and passes through processing units (B to D) in succession, perfect book bind processing is carried out. Two or more of the processing units (B to D) have pairs of members (2*b*, 2*c*; 3*c*, 3*d*; 4*a*, 4*b*) which engage or come into contact with both sides of a back surface of the book block A thickness of the book block is measured by a measuring unit (6) before the book binding processing is started. When a thickness of next book block is measured by a measuring unit during the book bind processing of a previous book block, a control section (7) stores a measured value of the thickness of the next book block in a memory (8). When the previous book block reaches a predetermined position on a conveying path, a gap between the pair of members of the processing unit located upstream of a position of the previous book block is adjusted based on the measured value stored in the memory. Thereafter, a gap between the pair of members of the processing unit located downstream of the predetermined position is adjusted based on the measured value stored in the memory when the previous book block passes through the processing unit. After the book bind processing of the previous book block is completed, a gap between the pair of clamping plates is adjusted based on the measured value stored in the memory.

3 Claims, 4 Drawing Sheets

BOOK BINDING APPARATUS FOR PERFECT BOOK BINDING

BACKGROUND OF THE INVENTION

1. Field of the Invention

The present invention relates to a book binding apparatus for perfect book binding. The book binding apparatus for perfect book binding comprises a conveying path, a series of processing units carrying out perfect book bind processing, a clamp unit provided with a pair of clamping plates and arranged for reciprocal movement along the conveying path, and a clamp unit driving mechanism reciprocating the clamp unit. The perfect-binding book binding processing is carried out while a book block is clamped between the pair of clamping plates and passes through the series of processing units in succession.

2. Description of the Related Art

There is known a conventional book binding apparatus continuously receiving book blocks of one book from a printer and a copying machine, and carrying out perfect book bind processing of book blocks one by one.

FIG. 4 is a schematic perspective view of a structure of one example of such a conventional book binding apparatus. Referring to FIG. 4, the conventional book binding apparatus for perfect book binding comprises a conveying path F, a series of processing units (milling unit B, glue application unit C and cover application unit D) which are arranged along the conveying path F for carrying out the perfect book bind processing, a clamp unit provided with a pair of clamping plates 1*a* and 1*b* and arranged for reciprocal movement along the conveying path F (only clamping plates 1*a* and 1*b* are shown in FIG. 4), and a clamp unit driving mechanism (not shown) reciprocating the clamp unit.

A book block P is subjected to the perfect-binding book binding processing while the book block P passes through the series of processing units in succession after the book block P is nipped by the pair of clamping plates 1*a* and 1*b* which is on standby at a book block inserting position A.

The pair of clamping plates 1*a* and 1*b* is composed of a stationary clamping plate 1*a* and a movable clamping plate 1*b*. The clamp unit comprises gap adjustment means (not shown) moving the movable clamping plate 1*b* in directions toward and away from the stationary clamping plate 1*a*. Before the book binding processing is started, the clamp unit is on standby in the book block inserting position A, and a gap between the pair of clamping plates 1*a* and 1*b* is previously adjusted according to the thickness of the book block P. When the book binding processing is started, in the book block inserting position A, the book block P is placed on an aligning plate 1*c* arranged in the book block inserting position A in such a manner that a back surface of the book block P faces downward, the book block P is inserted between the pair of clamping plates 1*a* and 1*b* of the clamp unit, and the book block P is nipped therebetween. Thereafter, the book block P is conveyed to the milling unit B by the clamp unit along the conveying path F.

The milling unit B comprises a milling cutter 2*a* and a pair of guide plates 2*b* and 2*c*. The pair of guide plates 2*b* and 2*c* is composed of a stationary guide plate 2*b* and a movable guide plate 2*c*. The movable guide plate 2*c* is moved by the gap adjustment means (not shown) in directions toward and away from the stationary guide plate 2*b*. A gap between the pair of guide plates 2*b* and 2*c* may be adjusted. Before the book binding processing is started, the pair of guide plates 2*b* and 2*c* is in a standby state where the gap therebetween is previously adjusted according to the thickness of the book block P. While the book block P nipped between the pair of clamping plates 1*a* and 1*b* passes above the milling cutter 2*a*, both sides of a back surface portion of the book block P protruding from the pair of clamping plates 1*a* and 1*b* are inserted between the pair of guide plates 2*b* and 2*c*. The both sides of the back surface portion of the book block P are thereby supported by the pair of guide plates 2*b* and 2*c* and the back surface of the book block P is grinded, and preprocessing for uniform application of glue on the entire back surface of the book block P is carried out. Then, the book block P nipped between the pair of clamping plates 1*a* and 1*b* is conveyed to the glue application unit C.

The glue application unit C comprises a glue tank 3*a* filled with glue, a gluing roller 3*b*, and a roller 3*c* for wiping excessive glue off. The glue application unit C applies an appropriate thickness of glue on the back surface of the book block P. When the gluing operation is completed, the book block P nipped between the pair of clamping plates 1*a* and 1*b* is conveyed to the cover application unit D.

The cover application unit D comprises a bottom plate 4*c* and a pair of nip plates 4*a* and 4*b*. The pair of nip plates 4*a* and 4*b* is composed of a stationary nip plate 4*b* and a movable nip plate 4*a*. A gap between the pair of nip plates 4*a* and 4*b* can be adjusted by moving the movable nip plate 4*a* by the gap adjustment means (not shown) in directions toward and away from the stationary nip plate 4*b*. Before the book binding processing is started, the pair of nip plates 4*a* and 4*b* is in a standby state where the gap therebetween is previously adjusted according to the thickness of the book block P. When the book binding processing is started, a printed cover Q is supplied onto the bottom plate 4*c* and the pair of nip plates 4*a* and 4*b* in a direction of an arrow S by appropriate conveying means such as a conveyer from a cover collecting section (not shown). Thereafter, the book block P nipped between the pair of clamping plates 1*a* and 1*b* stops at a position where the back surface of the book block P is opposed to a spine of the cover Q. Then, the bottom plate 4*c* and the pair of nip plates 4*a* and 4*b* rise, the cover Q is pressed against the spine of the book block P by the rising bottom plate 4*c* and at the same time, the movable nip plate 4*a* is moved toward the stationary nip plate 4*b*, and thereby the cover Q is pressed against both sides of the back surface of the book block P, the cover Q is glued on the book block P and a bound matter is completed. Thereafter, the clamp unit returns to the book block inserting position A, where the pair of clamping plates 1*a* and 1*b* is fully opened, the bound matter is discharged.

In the book binding apparatus for perfect book binding, it is often necessary to change the thickness of the book block P to be bound. In such a case, the gap between the pair of clamping plates 1*a* and 1*b* of the clamp unit on standby, the gap between the pair of guide plates 2*b* and 2*c* on standby of the milling unit B, and the gap between the pair of nip plates 4*a* and 4*b* on standby of the cover application unit D need to be adjusted.

Therefore, the conventional book binding apparatus for perfect book binding comprises a measuring unit for measurement of the thickness of the book block P so that the gap between the pair of clamping plates 1*a* and 1*b* on standby, the gap between the pair of guide plates 2*b* and 2*c* on standby of the milling unit B, and the gap between the pair of nip plates 4*a* and 4*b* on standby of the cover application unit D can be adjusted at once based on the measured value.

According to this structure, however, it is not possible to carry out the measuring operation of the thickness of the book block P, and the adjusting operation of the gap between the pair of guide plates 2*b* and 2*c* on standby and the gap between the pair of nip plates 4*a* and 4*b* on standby until the pair of clamping plates 1*a* and 1*b* returns to the book block inserting position A. When the thickness of the book block P is frequently changed, there is a problem that a rate of operation of the book binding apparatus for perfect book binding is significantly deteriorated.

SUMMARY OF THE INVENTION

Accordingly, it is an object of the present invention to provide a book binding apparatus for perfect book binding in which a rate of operation is not deteriorated even if a thickness of a book block to be bound is frequently changed.

In order to achieve this object, the present invention provides a book binding apparatus for perfect book binding comprising: a conveying path; a series of processing units arranged along the conveying path for carrying out perfect book bind processing; and a clamp unit provided with a pair of clamping plates and arranged for reciprocal movement along the conveying path; a clamp unit driving mechanism reciprocating the clamp unit. The perfect book bind processing is carried out while a book block is nipped between the pair of clamping plates and the book block passes through the series of processing units in succession. The book binding apparatus further comprises two or more of the processing units comprising pairs of members which engage or come into contact with both sides of a back surface portion of the book block protruding from between the pair of clamping plates, and gap adjustment means moving the pairs of members in directions toward and away from each other; a control section controlling the clamp unit and the gap adjustment means; and a measuring unit for measuring a thickness of the book block. The thickness of the book block is measured by the measuring unit before the book binding processing of the book block is started. A gap between the pair of clamping plates before nipping the book block, and gaps between the pairs of members of the processing units are previously adjusted in correspondence with the thickness of the book block based on the obtained measured value. When a thickness of a next book block is measured by the measuring unit during execution of the perfect-binding book binding processing of a previous book block, the control section stores the measured value of the thickness of the next book block in a memory. Then when the previous book block nipped between the pair of clamping plates reaches a predetermined position on the conveying path, the gaps between the pairs of members of the processing units located upstream of a position of the previous book block are adjusted based on the measured value stored in the memory. Thereafter, when the previous book block passes through the processing units, the gaps between the pairs of members of the processing units located downstream of the predetermined position are adjusted based on the measured value stored in the memory, and after the perfect book bind processing of the previous book block is completed, the gap between the pair of clamping plates is adjusted based on the measured value stored in the memory.

According to a preferred embodiment of the present invention, the measuring unit comprises: a base; a pair of support members fixed to the base with a distance therebetween; a guide rail extending between the pair of support members and supported by the support member; a slide body slidably guided by the guide rail, the slide body having a flat measuring surface; and a stationary body fixed to the base. The slide body slides in directions toward and away from the stationary body, and the stationary body has a reference surface opposed to the measuring surface of the slide body, so that the measuring surface abuts against the reference surface. The measuring unit farther comprises a moving distance measuring means for measurement of a moving distance of the measuring surface from the reference surface while setting, as a zero point, a position where the measuring surface of the slide body abuts against the reference surface of the stationary body. The thickness of the book block is measured by nipping the book block between the reference surface and the measuring surface.

According to another preferred embodiment of the present invention, the moving distance measuring means comprises: a pair of pulleys arranged on the base with a distance therebetween in an axial direction of the guide rail; an endless belt extending between the pair of pulleys for rotation, the slide body being connected to a portion of the endless belt; and means connected to a rotating shaft of one of the pulleys for measuring a rotation amount of the pulley, converting the rotation amount into a moving distance of the measuring surface of the slide body, and outputting the moving distance.

According to further preferred embodiment of the present invention, the measuring unit comprises: a display for indicating the measured value; and a numeric value changing section for changing a numeric value indicated on the display, zero point correction being made is such a manner that a numeric value zero is indicated on the display, when the slide body is abutted against the stationary body before the measurement of the thickness.

According to further preferred embodiment of the present invention, the series of processing units comprise at least a milling unit, a glue application unit and a cover application unit, and the milling unit has a pair of guide plates as the pair of members, the pair of guide plates supporting both sides of a back surface portion of the book block protruding from the pair of clamping plates during grinding processing of the back surface of the book block, and the cover application unit has a pair of nip plates as the pair of members, the pair of nip plates pressing a cover against the both sides of the back surface portion of the book block when the cover is attached to the back surface of the book block.

DETAILED DESCRIPTION OF THE PREFERRED EMBODIMENTS

Figure 1:
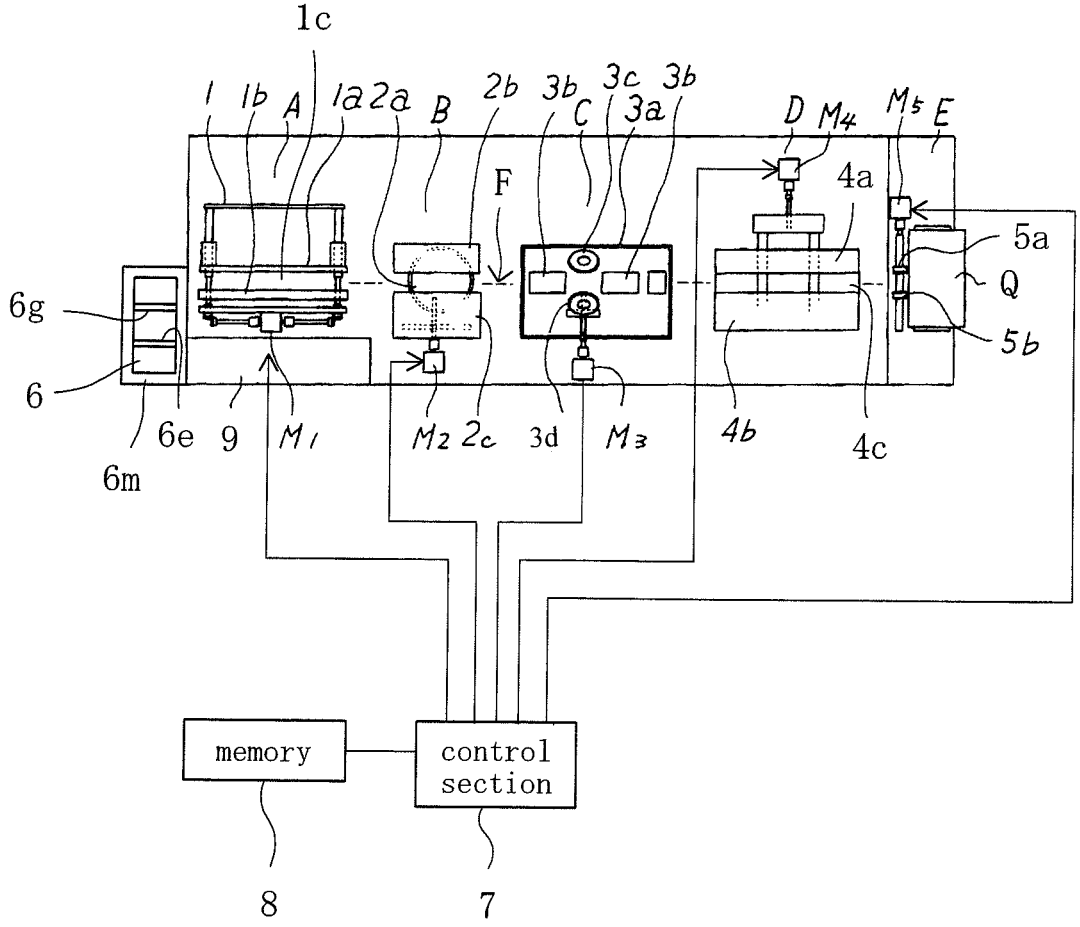
FIG. 1 is a schematic plan view illustrating a structure of a book binding apparatus for perfect book binding according to an embodiment of the present invention.
Figure 2:
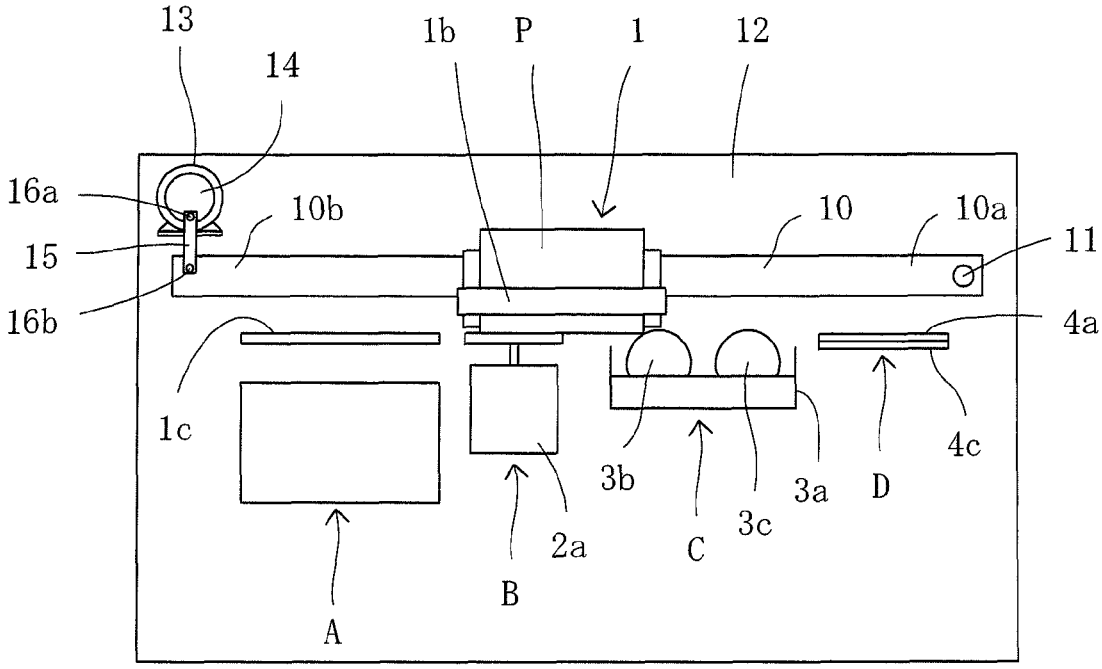
FIG. 2 is a side elevational view of the book binding apparatus for perfect book binding shown in FIG. 1.

Preferred embodiments of the present invention will be explained below with reference to the accompanying drawings. FIG. 1 is a schematic plan view illustrating a structure of a book binding apparatus for perfect book binding according to an embodiment of the present invention. FIG. 2 is a side elevational view of the book binding apparatus for perfect book binding shown in FIG. 1. As shown in FIG. 1, the book binding apparatus for perfect book binding of the present invention comprises a conveying path F, a series of processing units (milling unit B, glue application unit C and cover application unit D) arranged along the conveying path F for carrying out the perfect book bind processing, a clamp unit 1 provided with a pair of clamping plates 1*a* and 1*b* and arranged for reciprocal movement along the conveying path F, and a clamp unit driving mechanism reciprocating the clamp unit 1. In FIGS. 1 and 2, a symbol A represents a book block inserting position A where a book block P is inserted and nipped between the pair of clamping plates 1*a* and 1*b*. An aligning plate 1*c* for supporting a back surface of the book block P when the book block P is nipped between the pair of clamping plates 1*a* and 1*b* is arranged at the book block inserting position A. A symbol E represents a cover supply unit E for supplying a cover Q to the cover application unit D.

The clamp unit driving mechanism comprises a guide rail 10 arranged at a distance above the processing units B to D and extending along the conveying path F. The guide rail 10 is provided with an endless chain (not shown) which extends along the guide rail 10 and can be reciprocally rotated.

The clamp unit 1 is mounted on the guide rail 10 for slide movement. The clamp unit 1 is also connected to a portion of the endless chain, and reciprocates along the conveying path F as the endless chain is reciprocally rotated.

The guide rail 10 is pivotally attached to a turning shaft, which is fixed to a frame 12 of the book binding apparatus, at its one end 10*a* located on the side of the cover application unit D. A motor 13 is arranged on the side of the other end 10*b* of the guide rail 10 and fixed to the frame 12. A rotating disc 14 is mounted on a drive shaft of the motor 13. A rod 15 is pivotally attached to an outer periphery of the rotating disc 14 at its one end through a pin 16*a*, and pivotally attached to the other end 10*b* of the guide rail 10 at its other end through a pin 16*b*.

The rod 15 is vertically moved by drive of the motor 13. Accordingly, the guide rail 10 can be turned around the turning shaft 11 between a first position at which it extends horizontally along the conveying path F and a second position at which it inclines around the turning shaft 11 so as to escape upward from the processing units B to D.

The pair of clamping plates 1*a* and 1*b* of the clamp unit 1 is composed of a stationary clamping plate 1*a* and a movable clamping plate 1*b*. The movable clamping plate 1*b* is moved in directions toward and away from the stationary clamping plate 1*a* by drive of a motor M1 provided in the clamp unit 1.

The guide rail 10 is located in the first position. In the book block inserting position A, the book block P is placed on the aligning plate 1*c* in such a manner that a back surface of the book block P faces downward, and the book block P is nipped between the pair of clamping plates 1*a* and 1*b*. In this case, the book block P is arranged with respect to the pair of clamping plates 1*a* and 1*b* in such a manner that both sides of the back surface portion protrudes downward from the pair of clamping plates 1*a* and 1*b*. While the book block P is conveyed by the clamp unit 1 and made to pass through the series of processing units B to D in succession, the perfect-binding book bind processing is carried out. When the processing by the cover application unit D is completed, the guide rail 10 is turned from the first position to the second position, the clamp unit 1 is returned to the book block inserting position A along the guide rail 10, and the book block P with the cover Q is glued is discharged from the pair of clamping plates 1*a* and 1*b*.

The milling unit B comprises a milling cutter 2*a* and a pair of parallel guide plates 2*b* and 2*c*. The pair of guide plates 2*b* and 2*c* is composed of a stationary guide plate 2*b* and a movable guide plate 2*c*. The movable guide plate 2*c* is moved in directions toward and away from the stationary guide plate 2*b* by drive of a motor M2 provided in the milling unit B. Then a gap between the pair of guide plates 2*b* and 2*c* can be adjusted. Before the book binding processing is started, the pair of guide plates 2*b* and 2*c* is in a standby state where the gap therebetween is previously adjusted according to the thickness of the book block P. After the book binding processing is started, while the book block P nipped between the pair of clamping plates 1*a* and 1*b* passes above the milling cutter 2*a*, both sides of the back surface of the book block P protruding downward from the pair of clamping plates 1*a* and 1*b* are inserted between the pair of guide plates 2*b* and 2*c*. Thus the both sides of the back surface of the book block P is supported by the pair of guide plates 2*b* and 2*c* and the back surface of the book block P is grinded, and pre-processing for uniform application of glue on the entire back surface of the book block P is carried out. Then, the book block P nipped between the pair of clamping plates 1*a* and 1*b* is conveyed to the glue application unit C.

The glue application unit C comprises a glue tank 3*a* filled with glue, a gluing roller 3*b* for gluing on the back surface of the book block P, a pair of second gluing rollers 3*c* and 3*d* for gluing on both sides of the back surface of the book block P, and a roller 3*e* for wiping excessive glue off. The pair of second gluing rollers 3*c* and 3*d* is composed of a stationary gluing roller 3*c* and a movable gluing roller 3*d*. The movable gluing roller 3*d* is moved in directions toward and away from the stationary gluing roller 3*c* by drive of a motor M. Before the book binding processing is started, the pair of second gluing rollers 3*c* and 3*d* is in a standby state where the gap therebetween is previously adjusted according to the thickness of the book block P. While the book block P nipped between the pair of clamping plates 1*a* and 1*b* passes above the glue tank 3*a*, the pair of second gluing rollers 3*c* and 3*d* is engaged with the both sides of the back surface of the book block P, and glue is applied on both sides of the back surface of the book block P.

When the gluing operation is completed, the book block P nipped between the pair of clamping plates 1*a* and 1*b* is conveyed to the cover application unit D.

The cover application unit D comprises a bottom plate 4*c* and a pair of nip plates 4*a* and 4*b*. The pair of nip plates 4*a* and 4*b* is composed of a stationary nip plate 4*b* and a movable nip plate 4*a*. The movable nip plate 4*a* is moved in directions toward and away from the stationary nip plate 4*b* by drive of a motor M4 provided in the cover application unit D. Thus a gap between the pair of nip plates 4*a* and 4*b* may be adjusted. Before the book binding processing is started, the pair of nip plates 4*a* and 4*b* is in a standby state where the gap therebetween is previously adjusted according to the thickness of the book block P.

The cover supply unit E comprises a tray on which the cover Q is placed, and a cover supply mechanism for supplying the cover Q from the tray on the bottom plate 4*c* and the pair of nip plates 4*a* and 4*b* of the cover application unit D. The cover supply mechanism comprises a pair of folding rollers 5*a* and 5*b* for forming fold lines at a predetermined position of the cover Q. The pair of folding rollers 5*a* and 5*b* is composed of a stationary folding roller 5*a* and a movable folding roller 5*b*. The movable folding roller 5*b* is moved in directions toward and away from the stationary folding roller 5*a* by drive of a motor M5. Thus a gap between the pair of folding rollers 5*a* and 5*b* is previously adjusted according to the thickness of the book block P. In this state, the folding rollers 5*a* and 5*b* are on standby.

When the book binding processing is started, the cover Q is supplied on the bottom plate 4*c* and the pair of nip plates 4*a* and 4*b* of the cover application unit D from the cover supply unit E by the cover supply mechanism. While the cover Q is conveyed, two parallel fold lines are formed at predetermined positions of the cover Q by the pair of folding rollers 5*a* and 5*b*.

Thereafter, the book block P nipped between the pair of clamping plates 1*a* and 1*b* is stopped at a position where the back surface of the book block P is opposed to a spine of the cover Q (a portion of the cover Q between the parallel fold lines). The bottom plate 4*c* and the pair of nip plates 4*a* and 4*b* rise, the cover Q is pressed against the spine of the book block P by the bottom plate 4*c* and at the same time, the movable nip plate 4*a* is moved toward the stationary nip plate 4*b*. Accordingly, the cover Q is pressed against both sides of the back surface of the book block P, the cover Q is attached to the book block P, and the bound matter is completed.

Figure 3A:
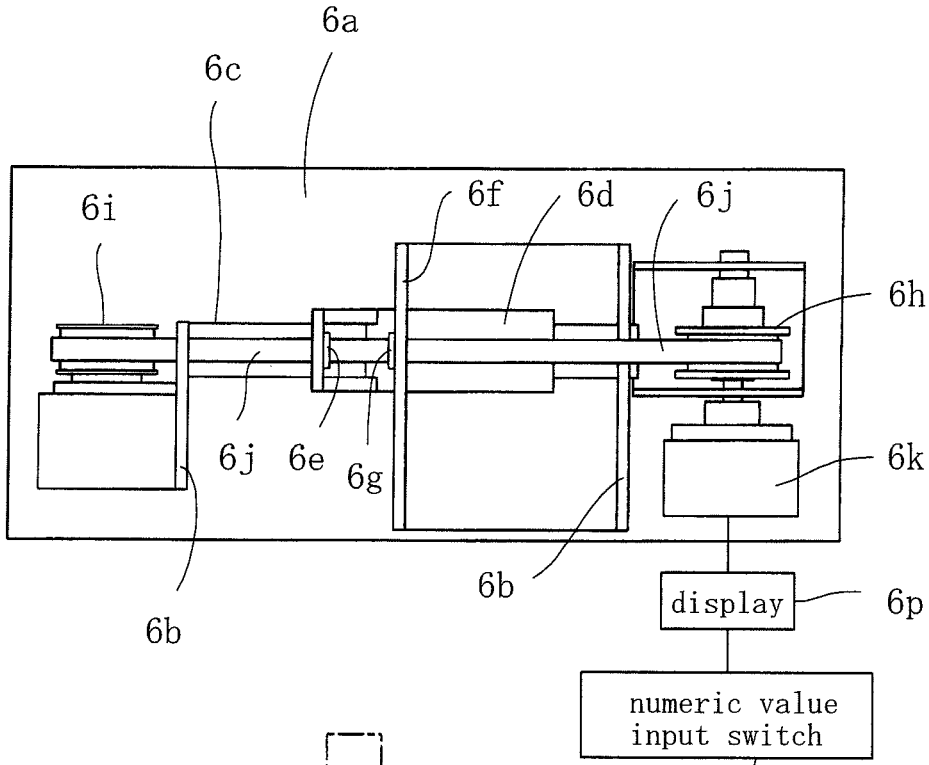
FIG. 3A is a plan view of a measuring unit provided in the book binding apparatus shown in FIG. 1.
Figure 3B:
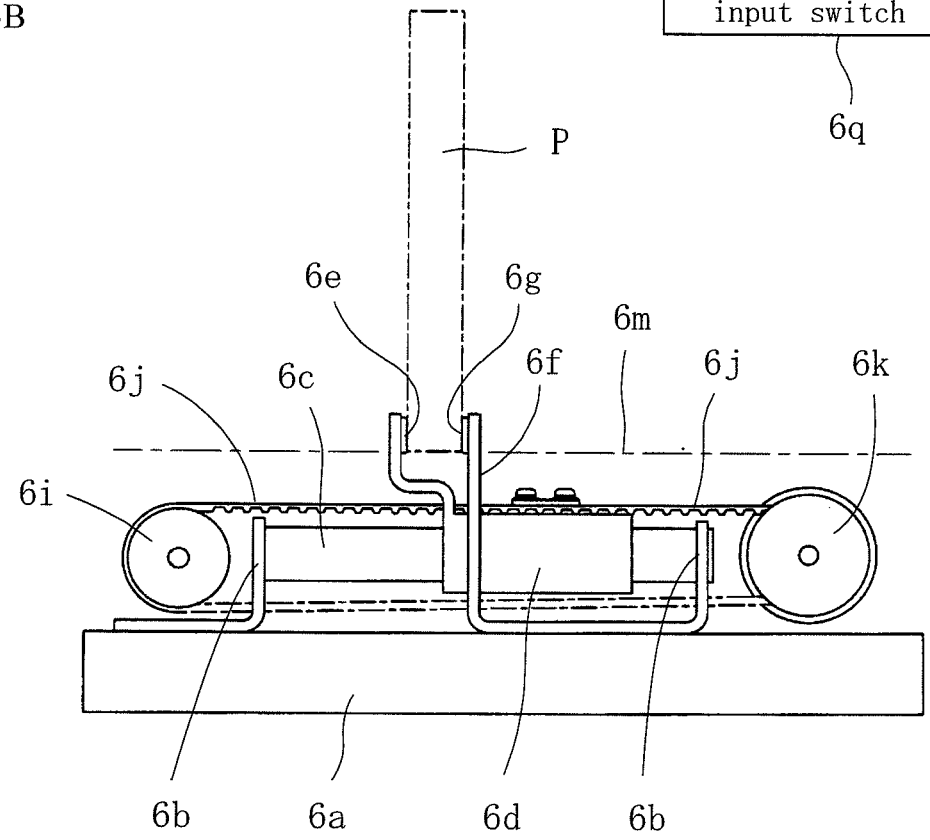
FIG. 3B is an elevational view of the measuring unit shown in FIG. 3A.
Figure 4:
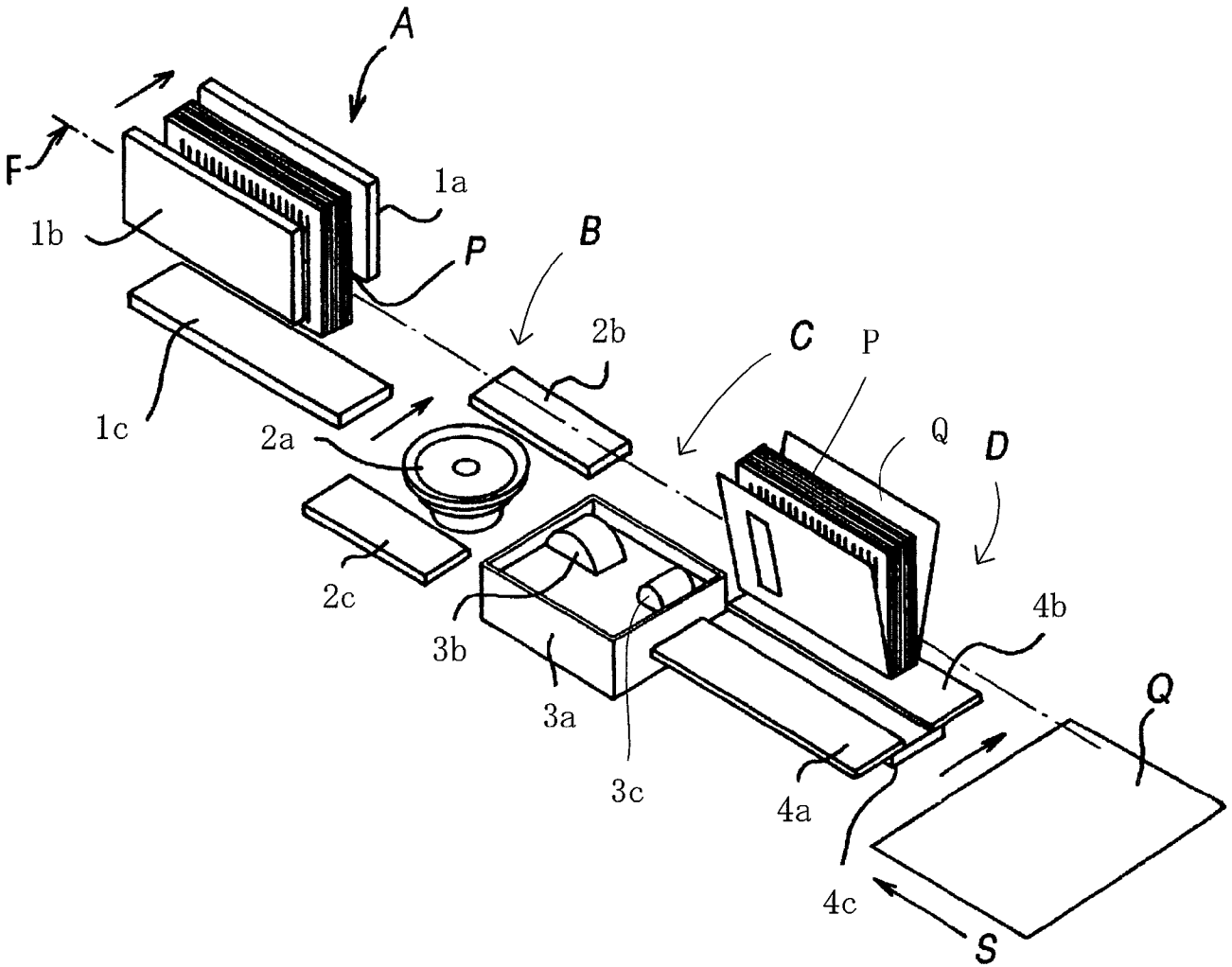
FIG. 4 is a schematic perspective view illustrating a structure of a conventional book binding apparatus for perfect book binding.

According to the present invention, the book binding apparatus comprises a measuring unit 6 for measurement of the thickness of the book block P. FIG. 3A is a plan view of the measuring unit provided in the book binding apparatus shown in FIG. 1. FIG. 3B is an elevational view of the measuring unit shown in FIG. 3A.

Referring to FIGS. 3A and 3B, the measuring unit 6 comprises a base 6*a*, pair of support members 6*b* fixed to the base 6*a* with a distance therebetween, and a horizontal straight guide rail 6*c* extending between the support members 6*b* and supported by the support members 6*b*.

The measuring unit 6 also comprises a slide body 6*d* slidably guided by the guide rail 6*c*. The slide body 6*d* has a through hole, and the slide body 6*d* is fitted into the guide rail 6*c* through the through hole. The slide body 6*d* comprises a flat measuring surface 6*e* extending perpendicularly to the guide rail 6*c*.

The measuring unit 6 further comprises a stationary body 6*f* fixed on the base 6*a*. The slide body 6*d* slides in directions toward and away from the stationary body 6*f*. The stationary body 6*f* comprises a flat reference surface 6*g* opposed to the measuring surface 6*e* of the slide body 6*d*. The measuring surface 6*e* can abut against the reference surface 6*g*. In this embodiment, the stationary body 6*f* is integrally formed on one of the support members 6*b*.

The measuring unit 6 further comprises moving distance measuring means. The moving distance measuring means measures a moving distance of the measuring surface 6*e* from the reference surface 6*g* while setting, as a zero point, a position where the measuring surface 6*e* of the slide body 6*d* abuts against the reference surface 6*g* of the stationary body 6*f* The moving distance measuring means comprises a pair of pulleys 6*h* and 6*i* arranged on both ends of the guide rail 6*c* and mounted on the base 6*a*. The moving distance measuring means also comprises an endless belt 6*j* extending between the pulleys 6*h* and 6*i* for reciprocal rotation. The pair of pulleys 6*h* and 6*i* is arranged for rotation around axes perpendicular to the guide rail 6*c* at right angles. A slide body 2 is connected to the endless belt 6*j*. The moving distance measuring means also comprises a device, e.g., a rotary encoder 6*k*, which is connected to a rotating shaft of the pulley 6*h* to measure a rotation amount of the pulley 6*h*. The rotary encoder 6*k* also converts the rotation amount into a moving distance of the measuring surface 6*e* of the slide body 6*d*, and outputs the moving distance.

The measuring unit 6 further comprises a display 6*p* for indication of a measured value, and a numeric value input switch 6*q* for confirming or changing a numeric value (measured value) indicated on the display 6*p*.

The measuring unit 6 is arranged adjacent to a table 9. The table 9 is disposed adjacent to the book block inserting position A of the book binding apparatus and used for neatly aligning the book block P. In this case, the measuring unit 6 comprises an auxiliary table portion 6*m* connected to the table 9 at the same level. The auxiliary table portion 6*m* is provided with a slot 6*n* extending along the guide rail 6*c*. The base 6*a* is fixed to a lower surface of the auxiliary table portion 6*m*, and at least the reference surface 6*g* of the stationary body 6*f* and measuring surface 6*e* of the slide body 6*d* project upward from an upper surface of the auxiliary table portion 6*m* through the slot 6*n*. The measuring surface 6*e* is slidably arranged.

After sheets composing the book block P are aligned on the table 9 prior to the book binding processing in this manner, the book block P is made to slide on the table in this state, and the book block P is inserted between the reference surface 6*g* and the measuring surface 6*e*. At this time, since the portion of the book block P lying outside either side of the reference surface 6*g* and the measuring surface 6*e* are supported by the auxiliary table portion 6*m* at its back face, the thickness thereof can be easily and precisely measured.

To prevent erroneous measurement which may occur due to expansion and contraction of the endless belt 6*j*, and to obtain a precise measured value, the measuring surface 6*e* of the slide body 6*d* is abutted against the reference surface 6*g* of the stationary body 6*f* before measurement of the thickness of the book block P, and zero point correction is made such that numeric value zero is indicated on the display 6*p* at the time.

The thickness of the book block P is measured in the following manner. After the zero point correction of the measuring unit 6, one side surface of the book block P is abutted on the reference surface 6*g* of the stationary body 6*f*, the slide body 6*d* is made to slide along the guide rail 6*c*, and the measuring surface 6*e* of the slide body 6*d* is abutted on the other side surface of the book block P. The obtained measured value is indicated on the display 6*p*.

Referring again to FIG. 1, according to the present invention, the book binding apparatus comprises a memory 8 and a control section 7 which controls the motor M1 of the clamp unit 1, the motor M2 of the milling unit B, the motor M3 of the glue application unit C, the motor M4 of the cover application unit D and the motor M5 of the cover supply unit E.

The thickness of the book block P is measured by the measuring unit 6 before the book binding processing of the book block P is started, and the control section 7 previously adjusts the gap between the pair of clamping plates 1*a* and 1*b*, the gap between the pair of guide plates 2*b* and 2*c* of the milling unit B, the gap between the pair of second gluing rollers 3*c* and 3*d* of the glue application unit C, the gap between the pair of nip plates 4*a* and 4*b* of the cover application unit D, and the gap between the pair of folding rollers 5*a* and 5*b* of the cover supply unit E before the book block P is nipped based on the obtained measured value according to the thickness of the book block P.

When a thickness of next book block P is measured by the measuring unit 6 during the book bind processing of a previous book block P, the control section 7 stores the measured value of the thickness of the next book block P in the memory 8. When the previous book block P nipped between the pair of clamping plates 1*a* and 1*b* reaches a predetermined position on the conveying path F, the gaps between the pair of members 2*b* and 2*c*; 3*c* and 3*d*; 4*a* and 4*b*; and 5*a* and 5*b* of the processing units B to E located upstream of the position of the previous book block P are adjusted based on the measured value stored in the memory 8. Thereafter, the gaps between the pair of members 2*b* and 2*c*; 3*c* and 3*d*; 4*a* and 4*b*; and 5*a* and 5*b* of the processing units B to E located downstream of the predetermined position are adjusted based on the measured value stored in the memory 8 when the previous book block passes through the processing units B to E. Then, after the book binding processing of the previous book block P is completed, the gap between the pair of clamping plates 1*a* and 1*b* is adjusted based on the measured value stored in the memory 8.

In this case, a rotary encoder is mounted on one of a pair of sprockets which turns the endless chain of the clamp unit driving mechanism. After the clamp unit 1 nips the book block P at the book block inserting position A, a convey start signal is output from the clamp unit 1 or a sensor disposed at the book block inserting position A when the book block P leaves the book block inserting position. At the same time when the convey start signal is received, the control section 7 starts an counting operation of the number of pulses outputted from the rotary encoder, thereby measuring the conveying distance of the book block P. When the conveying distance reaches a predetermined conveying distance, it is detected that the book block P has reached a predetermined position. In this embodiment, when the book block P reaches the cover application unit D, it is determined that the book block P has reached the predetermined position.

According to the present invention, even during execution of the book binding processing of the previous book block P, concerning the processing unit through which the previous book block P passed, it is possible to adjust the gap between the related pair of members according to a thickness of next book block. Therefore, it is possible to carry out the adjustment for the next book block P without waiting until the book binding processing of the previous book block P is completed and the clamp unit 1 returns to the book block inserting position A as in the conventional technique. Therefore, even when a thickness of book blocks to be bound is frequently changed, the rate of operation of the book binding apparatus is not deteriorated.

The invention claimed is:

1. A book binding apparatus for perfect book binding comprising:

a conveying path (F);

a series of processing units (B to D) arranged along the conveying path (F) for carrying out perfect book binding processing;

a clamp unit (1) provided with a pair of clamping plates (1*a* and 1*b*) and arranged for reciprocal movement along the conveying path (F);

a clamp unit driving mechanism for reciprocating the clamp unit (1), the perfect book binding processing being carried out while a book block (P) is nipped between the pair of clamping plates (1*a*, 1*b*) and the book block (P) passes through the series of processing units (B to D) in succession;

two or more of the processing units (B to D) comprising pairs of members (2*b*, 2*c*; 3*c*, 3*d*; 4*a*, 4*b*) which engage or come into contact with both sides of a back surface portion of the book block (P) protruding from between the pair of clamping plates (1*a*, 1*b*), and gap adjustment means (M2 to M4) for moving the pairs of members (2*b*, 2*c*; 3*c*, 3*d*; 4*a*, 4*b*) in directions toward and away from each other;

a control section (7) for controlling the clamp unit (1) and the gap adjustment means (M2 to M4); and a measuring unit (6) for measuring a thickness of the book block (P), the thickness of the book block (P) being measured by the measuring unit (6) before the book binding processing of the book block (P) is started, a gap between the pair of clamping plates (1*a*, 1*b*) before nipping the book block (P), and gaps between the pairs of members (2*b*, 2*c*; 3*c*, 3*d*; 4*a*, 4*b*) of the processing units (B to D) being previously adjusted in correspondence with the thickness of the book block (P) based on the obtained measured value, when a thickness of a next book block (P) is measured by the measuring unit (6) during execution of the perfect book binding processing of a previous book block (P), the control section (7) is operative for storing the measured value of the thickness of the next book block (P) in a memory (8), when the previous book block (P) nipped between the pair of clamping plates (1*a*, 1*b*) reaches a predetermined position on the conveying path (F), the gaps between the pairs of members (2*b*, 2*c*; 3*c*, 3*d*; 4*a*, 4*b*) of the processing units (B to D) located upstream of a position of the previous book block (P) being adjusted based on the measured value stored in the memory (8), thereafter, when the previous book block (P) passes through the processing units (B to D), the gaps between the pairs of members (2*b*, 2*c*; 3*c*, 3*d*; 4*a*, 4*b*) of the processing units (B to D) located downstream of the predetermined position being adjusted based on the measured value stored in the memory (8), and thereafter, after the perfect book binding processing of the previous book block (P) is completed, the gap between the pair of clamping plates (1*a*, 1*b*) being adjusted based on the measured value stored in the memory (8).

2. The book binding apparatus for perfect book binding according to claim 1, wherein the measuring unit (6) comprises:

a base (6*a*);

a pair of support members (6*b*) fixed to the base (6*a*) with a distance therebetween;

a guide rail (6*c*) extending between the pair of support members (6*b*) and supported by the support members (6*b*);

a slide body (6*d*) slidably guided by the guide rail (6*c*), the slide body (6*d*) having a flat measuring surface (6*e*);

a stationary body (6*f*) fixed to the base (6*a*), the slide body (6*d*) sliding in directions toward and away from the stationary body (6*f*), the stationary body (6*f*) having a reference surface (6*g*) opposed to the measuring surface (6*e*) of the slide body (6*d*), the measuring surface (6*e*) abutting against the reference surface (6*g*); and a means for measuring a moving distance of the measuring surface (6*e*) from the reference surface (6*g*) while setting, as a zero point, a position where the measuring surface (6*e*) of the slide body (6*d*) abuts against the reference surface (6*g*) of the stationary body (6*f*), the thickness of the book block (P) being measured by nipping the book block (P) between the reference surface (6*g*) and the measuring surface (6*e*).

3. The book binding apparatus for perfect book binding according to claim 1, wherein the series of processing units comprise at least a milling unit (B), a glue application unit (C) and a cover application unit (D), and the milling unit (B) has a pair of guide plates (2*b*, 2*c*) as the pair of members, the pair of guide plates (2*b*, 2*c*) supporting both sides of a back surface portion of the book block (P) protruding from the pair of clamping plates (1*a*, 1*b*) during grinding processing of the back surface of the book block (P), and the cover application unit (D) has a pair of nip plates (4*a* and 4*b*) as the pair of members, the pair of nip plates (4*a*, 4*b*) pressing a cover (Q) against both sides of the back surface portion of the book block (P) when the cover (Q) is attached to the back surface of the book block (P).

* * * * *